United States Patent [19]

Morrison

[11] 4,209,777

[45] Jun. 24, 1980

[54] NON-COMPROMISABLE INTRUSION SENSOR CIRCUIT

[75] Inventor: Richard L. Morrison, Petersburg, Tenn.

[73] Assignee: Teledyne Industries, Inc., Los Angeles, Calif.

[21] Appl. No.: 893,384

[22] Filed: Apr. 4, 1978

[51] Int. Cl.[2] ..... G08B 13/08

[52] U.S. Cl. ..... 340/547; 340/539

[58] Field of Search ..... 340/63, 64, 65, 528, 340/539, 545, 547, 568, 571, 541

[56] References Cited

U.S. PATENT DOCUMENTS

| | | | |
|---|---|---|---|
| 2,877,361 | 3/1959 | Chase | 340/547 |
| 3,828,340 | 8/1974 | Bauer, Jr. et al. | 340/539 |
| 3,986,183 | 10/1976 | Fujiwara | 340/547 |

*Primary Examiner*—Alvin H. Waring
*Attorney, Agent, or Firm*—Jim Zegeer

[57] ABSTRACT

An intrusion sensor circuit for protecting building openings having at least one moveable closure member, the sensor circuit including a magnet and a pair of magnetically operated switches mounted on the building opening and/or the moveable closure member therefor, the magnetic switches being commonly moveable relative to said magnet. An alarm circuit connected to the magnetically operated switches transmits an alarm signal to a receiving or monitoring station upon movement of the closure member a selected distance relative to the building opening when the circuit is armed. The pair of magnetic switches are positioned a short selected distance from each other, the first of the switches being positioned opposite a permanent magnet member on either the moveable closure member or the building opening and the first magnetic switch is adjacent thereto when the opening is closed. In a preferred embodiment, the first of the magnetic switches is maintained closed by the permanent magnet and the second one is normally open. There are four possible combinations of the magnetic switches being opened or closed, three of which will set off the alarm. The fourth situation when one switch is closed and the second space switch is open is the only combination which will keep the alarm turned off. The circuit includes a pair of NOR gates connected as a one shot multivibrator.

6 Claims, 3 Drawing Figures

NON-COMPROMISABLE INTRUSION SENSOR CIRCUIT

This invention relates to a non-compromisable intrusion sensor circuit for buildings and the like structures which have an opening such as a window, door, etc. closed by a moveable closure member. In the prior art, such openings have been protected against intrusion by alarm systems of various kinds but the particular one to which the present invention is concerned utilizes a permanent magnet mounted on, in the case of the double sash windows, one of the moveable window sash parts, and a magnetically operated switch which is mounted on the other moveable window sash part so that when in the closed position the double sash parts are oriented closed with respect to the frame that the magnet maintains the switch closed. A sensor circuit, which usually includes a one shot multivibrator. is connected to the switch and is activated or rendered operative to produce an output signal upon the opening of the magnetic switch which may be caused by movement of one or both sash members relative to the frame or to each other, as the case may be, to thereby shift the relative position of the magnet and the magnetic switch. Such systems are easily defeated by a burglar or other illegal entry persons by placing a permanent magnet adjacent to the magnetic switch so as to maintain it in the condition it is in while the moveable sash or closure member is opened. Thus, such systems are easily compromised and knowledgeable burglars could use this technique to compromise or intrude into protected areas.

The object of the present invention is to provide a relatively low-cost non-compromisable intrusion sensor circuit. According to this main feature of the invention, a pair of spaced magnetic switches are connected to a one shot multivibrator circuit having an input which must be pulled to a selected potential level, such as ground potential, to activate same which in turn activates the transmitter for transmitting a signal to some remote receiving station to give evidence of the intrusion to the monitors. In the preferred embodiment of the invention as disclosed herein, such a transmitter is a prior art radio transmitter mounted in a small package adjacent the protected enclosure. Such a transmitter may, as known in the art, transmit a signal to a larger transmitting unit, common to a plurality of intrusion sensors at other similarly protected building openings which may activate telephone lines or transmit a stronger signal to a remote monitoring station identifying the particular location and, if desired, the particular opening which has been violated.

Another object of the invention is to provide a system for detecting when the transmitter has been activated so as to thereby facilitate trouble shooting false alarms in the system. According to this feature of the invention, a latch circuit constituted by a pair of NOR gates is utilized to sense the activation of the transmitter. Since the transmitter is activated by the one shot multivibrator for only a short time duration, the latch circuits can be tested to see if the transmitter has been turned on and thereby facilitate trouble shooting false alarms in the system.

The above and other objects, advantages and features of the invention will become more apparent from the following description when taken in conjunction with the accompanying drawings wherein:

BRIEF DESCRIPTION OF THE DRAWINGS

As shown in FIG. 1, the alarm circuit of the invention includes a pair of normally open magnetic switches S1 and S2 which may be typical magnetic reed switches each activatable or closed by the presence of a permanent magnetic or other form of magnetic field. In the condition shown in FIG. 1, both magnetic switches are shown as normally open, but it will be appreciated that when a permanent magnet M1, as shown in FIG. 2, is positioned adjacent switch S1, the switch is closed to constitute the alarm inactivated state or condition. Switch S1 is connected in a series circuit with a voltage divider constituted by a resistor R1 (of medium value of about 180 K ohms), and a large value resistor R2 (about 1 megohm). The upper end of resistor R1 is connected to the voltage supply $V_{cc}$ which may be a small 9-volt transistor battery. Thus, about 1.18 megohm is connected across the battery in a normal condition with switch S1 closed so that a very small current drain is applied to the battery.

Figure 1:
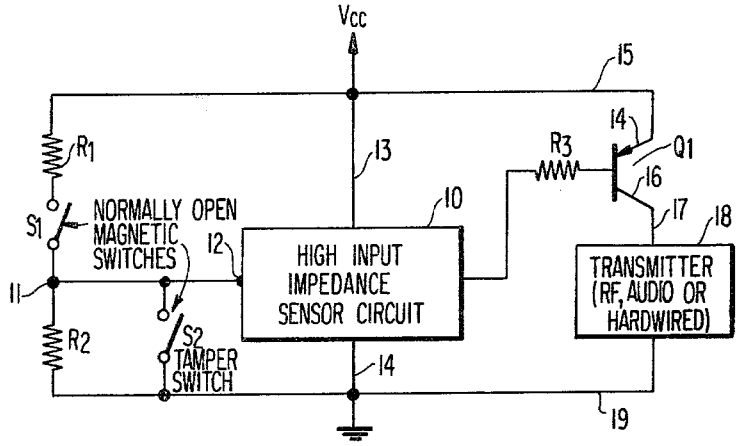
FIG. 1 is a schematic block diagram of an alarm circuit incorporating the non-compromisable intrusion sensor circuit of this invention.

A high input impedance sensor circuit 10 is connected to have its input 11 connected to the intermediate point 12 between resistor R2 and the lower terminal of switch S1. The high input impedance circuit (described more fully hereinafter) is also connected to the supply $V_{cc}$ by a conductor 13 and to ground or common by a conductor 14. It will be appreciated that the circuit conductors shown may be formed on a printed circuit board as is conventional. The output of the high input impedance sensor circuit 10 is supplied through a resistor R3 (about 3.9 K ohms) as the input to the base electrode of transistor Q1. Transistor Q1 is a PNP transistor having its emitter electrode 14 connected by conductor 15 to the supply $V_{cc}$ and its collector electrode 16 connected through conductor 17 to energize a transmitter 18 which is connected to ground through conductor 19. Transmitter 18 may be a conventional small RF transmitter for transmitting an alarm signal to a remote receiving station. As indicated earlier, the remote receiving station may include an automatic telephone dialer located within the protected premises to telephone a monitoring station or be another radio transmitter of sufficient power to transmit to a remote local receiving system such as at a local police station. Such systems are conventional and are disclosed in U.S. Pat. Nos. 4,023,139 (Samburg), 3,997,890 (Kendrick, Jr.), 3,828,340 (Bauer et al), and 3,896,427 (Campman).

When switch S1 is closed, R1 and R2 constitute a voltage divider and the voltage at intermediate point 12 is supplied to the input of high input impedance sensor circuit 10 to thereby assure that there is no output signal from the sensor circuit 10. When the switch S1 is open, the high input impedance sensor circuit has the input thereof pulled to ground or zero by virtue of the 1 megohm resistor R2, and the cut-off voltage has been removed. This activates the high input impedance sensor circuit 10 and thereby energizes transistor Q1 to energize and activate transmitter 18 to transmit the alarm.

Figure 2:
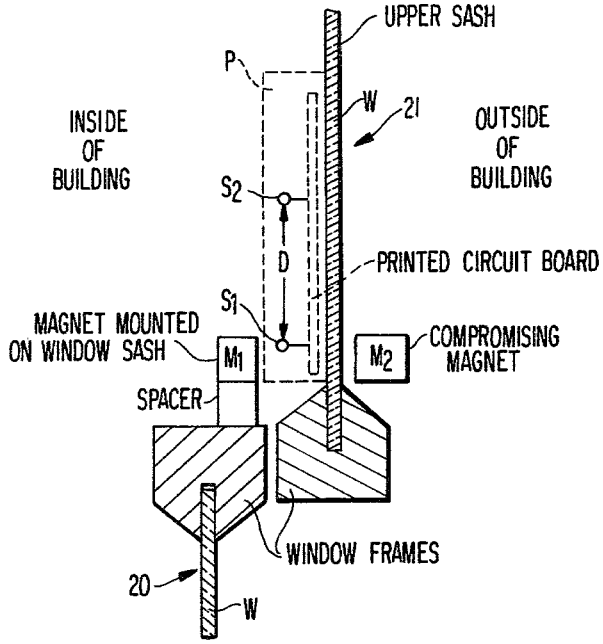
FIG. 2 is a cross-sectional schematic illustration of a double hung window sash to which the invention has been applied.

The system described thus far is easily defeated or compromised by burglars and the like unlawful entry personages. Referring to FIG. 2, a compromising magnet M2 is shown positioned adjacent switch S1. This is very often easily discernible by knowledgeable burglars or unlawful intruders since the transmitter and sensor package P is affixed to the window glass W. The positioning of magnet M2, which is affixed to the upper window frame edge of sash 20 adjacent switch S1 from the exterior of the protected premises, prevents the activation of the transmitter because when the lower sash 20 is moved upward relative to upper sash 21, the compromising magnet M2 maintains the switch S1 closed so that the alarm is not sounded.

In accordance with the invention, a further normally open magnetic switch S2, labelled "tamper switch" in FIG. 1, is positioned a short distance D from switch S1. Switch S2 is a normally open magnetic switch and is connected in shunt across resistor R2 and the input terminal 11 and ground of the high input impedance sensor circuit 10. Thus, while S1 is normally held closed by magnet M1, the tamper switch S2 is open. To activate the transmitter and set off the alarm, the input to the high impedance sensor circuit must be pulled to ground, as indicated earlier but, out of the four possible combinations of S1 and S2 being open or closed (S1 open-S2 open, S1 closed-S2 closed, and S1 open-S2 closed), three of them will set off the alarm. Switch S1 is closed and switch S2 being open is the only combination which will keep the alarm turned off.

Thus, with reference to FIG. 2, in normal operation, both the upper sash 21 and lower sash 20 are closed so that magnetic switch S1 is held closed by magnet M1. When a compromising magnet M2 is brought by the intruder adjacent to magnetic reed switch S1, that switch is maintained closed by the magnet M2. However, when the burglar or unlawful intruder seeks to effect relative movement between lower sash 20 and upper sash 21, while switch S1 will be maintained closed, the magnet M1 will move (relatively) the distance D to position magnetic switch S2 adjacent magnet M1 and magnetic switch S2 will close and activate the alarm because the tamper switch S2 then will close thereby pulling the high input impedance sensor circuit 10 to ground.

Figure 3:
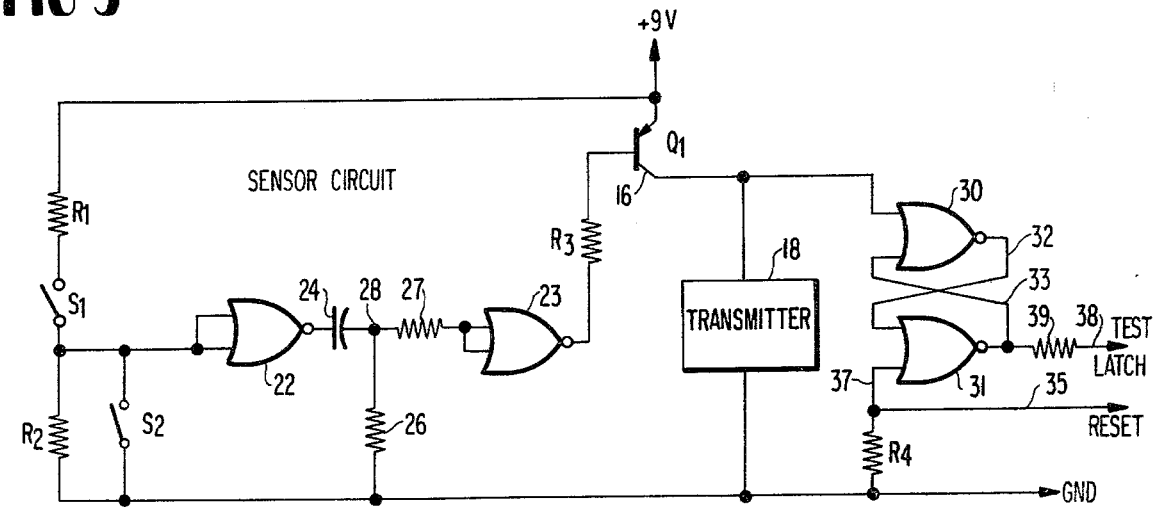
FIG. 3 is a detail schematic diagram of an alarm circuit which incorporates the invention.

Referring to the detailed schematic shown in FIG. 3, the high input impedance sensor circuit is constituted by a pair of logical NOR gates 22 and 23 connected as a one shot multivibrator, whose duration is set by the RC circuit constituted by a 4.7 microforad capacitor 24 and a 180 K ohm resistor 26. A 10 K ohm resistor 27 connects the point 28 intermediate resistor 26 and capacitor 24 to the input of the second NOR gate 23. Note that both NOR gates have two inputs connected together (as inverters) so that both receive logical ones or logical zeros as is conventional, the supply voltage to these gates (as well as gates 30 and 31) are not shown. This one shot circuit, which is not per se novel herein, operates as follows: When switch S1 is closed, the voltage at intermediate point 12 is some fraction of the $V_{cc}$ supply voltage and constitutes a one on the inputs to NOR gate 22 so the output is zero. NOR gate 23 with two zero inputs produces a one or high at its output which is coupled through resistor R3 to the base of PNP transistor to maintain this transistor turned off. When either switch S1 opens or switch S2 closes, the output of NOR gate 22 goes high which in turn makes the input to NOR gate 23 to high and start to charge up capacitor 24. While capacitor 24 is charging up there is a low or zero on the output of NOR gate 23 which turns on PNP transistor Q1. This momentarily energizes transmitter 18 to cause it to transmit an alarm signal to a monitoring station. When capacitor 24 is charged up, the input to NOR gate 23 goes low or logic zero at which time a high is on the output thereof, turning transistor Q1 off.

The alarm will also be activated if the comprising or intrusion magnet M2 on the outside of the building is placed close enough to the tamper switch S2 to cause it to close.

It will be appreciated that instead of permanent magnets M1, electromagnets may be utilized for this magnet and connected in a single circuit with all of, for example, the windows of a building so that the intrusion circuit may be activated or energized from a common circuit.

The detailed circuit illustrated in FIG. 3 includes the non-compromisable intrusion circuit shown in FIG. 1 and, in addition, a latch circuit has been added. The latch circuit is constituted by a pair of cross-connected NOR gates 30 and 31, which can, of course, by commonly formed in an integrated circuit chip and package with NOR gates 22 and 23.

As shown in FIG. 3, the latch circuit is connected in shunt with the transmitter 18 and an isolation resistor R4 (of about 10 K ohm). NOR gate 30 of the latch circuit has one input thereof connected to collector electrode 16 of transistor Q1 and the output thereof is connected by a lead 32 to an input of NOR gate 31. NOR gate 31 has its output connected via conductor 33 as a second input to NOR gate 30. The circuit operates as a bistable latch circuit and, upon activation of transistor Q1 and, in turn, the transmitter 18, the latch circuit is set and it must be manually reset. Since the transmitter is activated for only a short duration (determined by the RC time constant of capacitor 24 and resistor 26), this latch circuit can be tested to see if the transmitter has been turned on at some previous time. This feature facilitates trouble shooting false alarms in the system. A reset terminal 35 is provided across the resistor R4 so as to provide a reset signal to the lead 37 of NOR gate 31. This resets the circuit. The latch terminal 38 is connected through an isolating resistor 39 to the output or NOR gate 31. As indicated earlier, the voltage supply connection to the NOR gates is not shown, as is conventional.

It will be appreciated that the addition of magnetic switch S2 and its arrangement in the high input impedance sensor circuit 10 are the basic elements of the invention which renders the magnetic intrusion sensor circuit non-compromisable by an external compromising magnet such as the one shown on the outside of the building in FIG. 2 of the drawings.

Instead of being a small RF transmitter, the intrusion circuit itself may be utilized in other alarm transmitting systems wired directly to a monitoring station or for transmitting the alarm signals via radio waves, telephone lines, etc. Since the circuit has an extremely high impedance connected across the battery, current drain is extremely low during non-alarm periods. Moreover, since the switch S2 is preferably contained within a housing or package P for the sensing circuit as well as the radio transmitter, its position is disguised and any breakage of glass will provide a relative movement between switch S1 and the magnet M1, thereby sounding the alarm.

In the preferred embodiment as disclosed herein, the switches S1 and S2 are in a normally open condition. However, it will be appreciated that the normally closed magnetic switches can be utilized in a circuit in which magnet M1 holds switch S2 open and the opening of switch S2 is sensed upon movement thereof from adjacent magnet M1 or, in case a compromising magnet M2 being used, when switch S1 (which in this embodiment is in the physical position of switch S2 in FIG. 2) is opened by its proximity to magnet M1. It will be further appreciated that instead of magnetic switches, other functionally equivalent switch pairs may be utilized and, in fact, a combination of magnetic and non-magnetically operated switches may be incorporated in the invention.

It is to be understood that modifications and variations may be effected in the invention without departing from the spirit and scope thereof.

What is claimed is:

1. In an intrusion sensor system for protecting a building opening having at least one moveable closure member, and a system magnet and first magnetically operated switch mounted and oriented for relative movement with respect to each other and/or said building opening, and an alarm transmitter connected to said magnetically operated switch for transmitting an alarm signal to a receiving station upon relative movement between said magnet and said magnetically operated switch, the improvement in rendering said intrusion sensor circuit non-compromisable from the exterior of said building by a compromising magnet comprising, a further magnetically operated switch positioned a short distance away from said first magnetic switch and along a path defined by the constrained movement of said moveable closure member relative to said system magnet, said magnetic switches being normally of the opposite state when in a protecting position relative to said system magnet such that one of said magnetic switches is operated by the nearness of said system magnet to thereby arm the system and movement of said first magnetic switch away from said system magnet so as to position the other of said magnetic switches adjacent said system magnet energizes said alarm regardless of the condition of said first magnetic switch, and a sensing circuit for sensing the condition of said magnetic switches and producing said alarm signal.

2. The invention defined in claim 1 including a relatively high impedance element, said further magnetically operated switch is connected in parallel with said relatively high impedance element, and in series with said first magnetically operated switch, and means connecting a point intermediate said switches to the input of said sensing circuit.

3. The invention defined in claim 1 wherein said sensing circuit includes a pair of logical NOR gates, each NOR gate having all its inputs commonly connected together, an RC timing circuit interconnecting said NOR gates to constitute a one shot multivibrator, a source of direct current voltage having a pair of terminals, a voltage divider connected across said direct current voltage source, means connecting an intermediate point on said voltage divider to the input of the first of said NOR gates, said first magnetically operated switch being connected in series circuit with said voltage divider and between said intermediate point and a first terminal of said direct current voltage source, said further magnetically operated switch being connected in parallel between the portion of said voltage divider connected between said intermediate point and the other terminals of said direct current voltage source.

4. The invention defined in claim 3 including a latch circuit connected to be actuated to a set state by said alarm signal, a pair of terminal means on said sensor circuit for permitting said latch circuit to be tested to see if the alarm signal has been produced during a previous selected time period, and a further terminal means for permitting said latch circuit to be manually reset, thereby facilitating trouble shooting false alarms in the system.

5. The invention defined in claim 4 wherein said latch circuit is constituted by a further pair of cross-connected NOR gates.

6. An intrusion alarm circuit comprising in combination:

a source of voltage having output terminals, a pair of impedance elements connected in series across the output terminals of said source of voltage, with an intermediate point therebetween, a pair of intrusion switches connected in series with each other across said output terminals of said source, one of said switches being connected in parallel with one of said impedance elements and the other of said switches being connected in series with the other of said impedance elements, and having an intermediate point between said impedance elements, and an alarm means connected to said intermediate point for sensing a change in the relative states of said pair of switches caused by an intruder.

* * * * *